US007983596B2

(12) United States Patent
Hagiwara et al.

(10) Patent No.: US 7,983,596 B2
(45) Date of Patent: Jul. 19, 2011

(54) HOUSING STRUCTURE AND IMAGE FORMING APPARATUS

(75) Inventors: Genta Hagiwara, Ikeda (JP); Katsumi Kumada, Minoo (JP); Nobuhiko Kita, Suita (JP); Sei Onuma, Ikeda (JP); Haruo Hashimoto, Ikeda (JP); Masafumi Takahira, Toyonaka (JP); Kaoru Tada, Toyonaka (JP)

(73) Assignee: Ricoh Company, Limited, Tokyo (JP)

( * ) Notice: Subject to any disclaimer, the term of this patent is extended or adjusted under 35 U.S.C. 154(b) by 17 days.

(21) Appl. No.: 12/585,427

(22) Filed: Sep. 15, 2009

(65) Prior Publication Data

US 2010/0067942 A1 Mar. 18, 2010

(30) Foreign Application Priority Data

Sep. 16, 2008 (JP) ..... 2008-236483

(51) Int. Cl.
*G03G 15/00* (2006.01)
*G03G 21/00* (2006.01)

(52) U.S. Cl. ..... 399/110; 399/118; 399/125

(58) Field of Classification Search ..... 399/125, 399/107, 110, 118; 347/138, 152
See application file for complete search history.

(56) References Cited

U.S. PATENT DOCUMENTS

| | | | | |
|---|---|---|---|---|
| 7,041,081 | B2 * | 5/2006 | Minezaki et al. | 604/151 |
| 7,353,922 | B2 * | 4/2008 | Furuya et al. | 188/284 |
| 2006/0140670 | A1 * | 6/2006 | Choi et al. | 399/110 |
| 2007/0065201 | A1 | 3/2007 | Fujiwara et al. | 399/405 |
| 2007/0110473 | A1 | 5/2007 | Kondo et al. | 399/117 |
| 2007/0110475 | A1 | 5/2007 | Idehara et al. | 399/118 |
| 2007/0166073 | A1 | 7/2007 | Idehara et al. | 399/110 |
| 2007/0246638 | A1 | 10/2007 | Idehara et al. | 248/677 |
| 2008/0006166 | A1 | 1/2008 | Ohkubo et al. | 101/479 |
| 2008/0007935 | A1 | 1/2008 | Kondo et al. | 361/829 |
| 2008/0050146 | A1 | 2/2008 | Kita et al. | 399/107 |
| 2008/0063425 | A1 | 3/2008 | Idehara et al. | 399/93 |
| 2008/0075502 | A1 | 3/2008 | Tada et al. | 399/111 |
| 2008/0226358 | A1 | 9/2008 | Hanashima et al. | 399/299 |
| 2008/0253796 | A1 | 10/2008 | Idehara et al. | 399/92 |
| 2008/0279585 | A1 | 11/2008 | Furuichi et al. | 399/118 |
| 2008/0292356 | A1 | 11/2008 | Furuichi et al. | 399/112 |
| 2009/0022514 | A1 | 1/2009 | Fujiwara et al. | 399/121 |
| 2009/0074446 | A1 | 3/2009 | Idehara et al. | 399/107 |
| 2009/0074456 | A1 | 3/2009 | Tada et al. | 399/124 |

(Continued)

FOREIGN PATENT DOCUMENTS

| | | |
|---|---|---|
| JP | H02-210462 | 8/1990 |

(Continued)

*Primary Examiner* — Sophia S Chen
(74) *Attorney, Agent, or Firm* — Harness, Dickey & Pierce, P.L.C.

(57) ABSTRACT

A housing structure includes a first structure, which has body frames and a first shaft supported by the body frames, a second structure to be movably supported between an opened position and a closed position by the first shaft, and a positioning device to position the second structure in relation to the first structure in the closed position. The positioning device includes a first engagement portion provided on the first structure, a second engagement portion provided on the second structure and engaged with the first engagement portion in the closed position, a first biasing device to bias the second engagement portion toward the second structure, and a second biasing device to bias the second engagement portion toward the first structure. The positioning device positions the second structure in relation to the first structure by biasing forces of the first biasing device and the second biasing device.

13 Claims, 5 Drawing Sheets

U.S. PATENT DOCUMENTS

2009/0080937 A1 3/2009 Kita et al. ..... 399/166
2009/0110432 A1 4/2009 Idehara et al. ..... 399/107
2009/0121418 A1 5/2009 Tanaka et al. ..... 271/226
2009/0152435 A1 6/2009 Kondo et al. ..... 248/634
2009/0174135 A1 7/2009 Tanaka et al. ..... 271/10.01

FOREIGN PATENT DOCUMENTS

JP H05-323686 12/1993

* cited by examiner

HOUSING STRUCTURE AND IMAGE FORMING APPARATUS

CROSS-REFERENCE TO THE RELATED APPLICATIONS

The present application is based on and claims priority from Japanese Application Number 2008-236483, filed on Sep. 16, 2008, the disclosure of which is hereby incorporated by reference herein in its entirety.

BACKGROUND OF THE INVENTION

1. Field of the Invention

The present invention relates to a housing structure having a main body structure and a cover structure, equipment being housed in the main body structure and the cover structure, and to an image forming apparatus such as a printer having the housing structure, a copying machine, a facsimile, a digital composite machine, and the like.

2. Description of the Related Art

Conventionally, an image forming apparatus having a writing unit by use of a laser beam has been known. In such an image forming apparatus, generally, the writing unit is fixed in a main body of the image forming apparatus. However, in such a system, a photoconductive drum unit is required to pass around the writing unit when the photoconductive drum unit is installed in or removed from the main body so that low operability for changing parts and large size of the apparatus are caused. Then, technology for solving the above problems is disclosed in, for example, Japanese Patent Application Publication Nos. H05-323686 and H02-210462.

In Japanese Patent Application Publication No. H05-323686, the main body of the image forming apparatus consists of an upper structure and a lower structure. The upper structure is disposed to be openable and closable about a supporting point on the lower structure and a coil spring is provided at the supporting point to bias the upper structure in an opening direction. When the upper structure is opened, a direction of gravity affecting the upper structure is switched from an opening direction to a closing direction of the upper structure through a position of the supporting point. The housing structure includes an impact absorbing elastic member for absorbing an impact occurring when the upper structure is in an opened position based on the gravity. Thereby, even when the upper structure is in the opened position based on the gravity, the impact absorbing elastic member can prevent the lower structure from being affected by a large impact and from the characteristics of parts provided in the apparatus from being affected by the influence of a large impact.

In Japanese Patent Application Publication No. H02-210462, an image forming unit includes positioning members having the same shape as each other at both sides of the image forming unit. The positioning member has, at one side, a first shaft portion for supporting a photoconductive drum and a second shaft portion for supporting a roller, and, at the other side, an engagement portion disposed coaxially with the first shaft portion. The image forming unit is positioned on the main body through the engagement portion. Thereby, a driving gear of the photoconductive drum can be highly accurately engaged with a driving system of the main body.

In Japanese Patent Application Publication No. H05-323686, it is disclosed that, when the upper structure including the writing unit is closed onto the lower structure, a pressing-up spring is provided for applying a biasing force in a direction opposite to the closing direction of the upper structure. The biasing force of the pressing-up spring is applied when a distance between the lower structure and the upper structure reaches a predetermined value or less.

In Japanese Patent Application Publication No. H02-210462, the writing unit is fixed on the upper cover and rotated. The upper cover is biased in the opening direction and any impact occurring when the writing unit is closed is absorbed.

Although both of Japanese Patent Application Publication Nos. H05-323686 and H02-210462 disclose the use of the elastically biasing force when the upper cover structure is closed, there is a problem of accurate positioning of the writing unit. If the writing unit is supported in a floating state in the upper cover and then positioned on the main body, it may be possible to use a damper for reducing the closing speed of the upper cover, but this is costly. In addition, the positioning portion of the writing unit and the main body of the image forming apparatus is commonly made of a hard material such as a resin including glass, or the like and therefore impact occurs when the hard materials collide with each other.

SUMMARY OF THE INVENTION

An objective of the present invention is to provide a housing structure which can improve accuracy in relatively positioning equipment provided in a cover part and equipment provided in a main body part when the cover part is closed onto the main body and buffer impact affecting equipment provided in the cover part when performing a closing operation.

To achieve the above object, a housing structure according to an embodiment of the present invention includes a first structure configured to house a main body functional part, the first structure having body frames disposed at opposite sides of the first structure and a first shaft supported by the body frames; a second structure configured to house a separate body functional part and to be movably supported between an opened position and a closed position by the first shaft of the first structure; and a positioning device configured to position the separate body functional part in relation to the main body functional part in the closed position. The positioning device includes a first engagement portion provided on the first structure; a second engagement portion provided on the second structure, the second engagement portion being engaged with the first engagement portion in the closed position; a first biasing device configured to bias the second engagement portion toward the second structure; and a second biasing device configured to bias the second engagement portion toward the first structure. The positioning device is configured to position the separate body functional part in relation to the main body functional part by biasing forces of the first biasing device and the second biasing device.

DETAILED DESCRIPTION OF THE PREFERRED EMBODIMENTS

Preferred embodiments of a housing structure according to the present invention will be explained in detail with reference to the accompanying drawings below.

Figure 3:
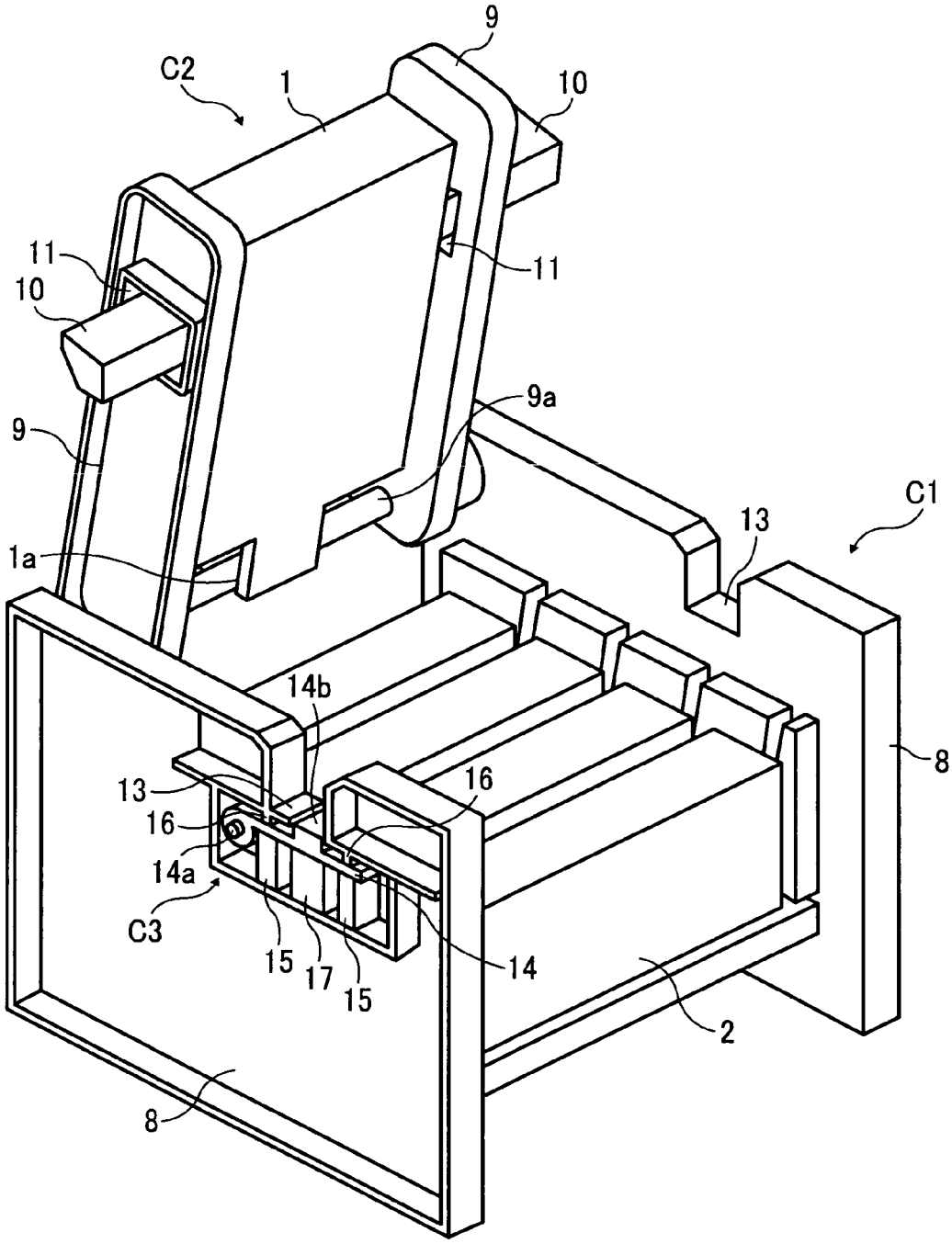
FIG. 3 is a view illustrating a state where the optical writing part is rotated in relation to the body frames.

As shown in, for example, FIG. 3, the housing structure according to an embodiment of the present invention includes a first structure such as a main body C1 configured to house a main body functional part 2, the first structure having body frames 8 disposed at opposite sides of the first structure and a first shaft 9*a* supported by the body frames 8, a second structure such as a cover part C2 configured to house a separate body functional part 1 and to be movably supported between an opened position and a closed position by the first shaft 9*a* of the first structure C1; and a positioning device C3 configured to position the separate body functional part 1 in relation to the main body functional part 2 in the closed position. As shown in, for example, FIG. 4, the positioning device C3 includes a first engagement portion 13 provided on the first structure C1, a second engagement portion such as a supporting member 10 provided on the second structure C2, the second engagement portion 10 being engaged with the first engagement portion 13 in the closed position, a first biasing device C31 configured to bias the second engagement portion 10 toward the second structure C2, and a second biasing device 12 configured to bias the second engagement portion 10 toward the first structure C1. The positioning device C3 is configured to position the separate body functional part 1 in relation to the main body functional part 2 by biasing forces of the first biasing device C31 and the second biasing device 12. The first biasing device C31 may include a first biasing member 15 and/or a damper 17 (see FIGS. 4 to 6).

The positioning device C3 includes a movable receiving member 14 configured to make contact with the supporting member 10 and to be pressed by the first biasing device C31 to position the second structure C2 in relation to the first structure C1 in the closed position.

A biasing force of the first biasing device C31 is preferably set to be larger than a biasing force of the second biasing device 12.

Positioning members 16 are provided on the body frame 8 of the first structure C1. The movable receiving member 14 is positioned at a predetermined position of the first structure C1 by the positioning members 16 in a state where the movable receiving member 14 is pressed by the first biasing device C31.

The supporting member 10 is configured to make contact with the movable receiving member 14 in a state where the supporting member 10 is biased by the second biasing device 12 toward the first structure C1.

The housing structure of an embodiment of the present invention may be used in an image forming apparatus such as a printer.

Figure 1:
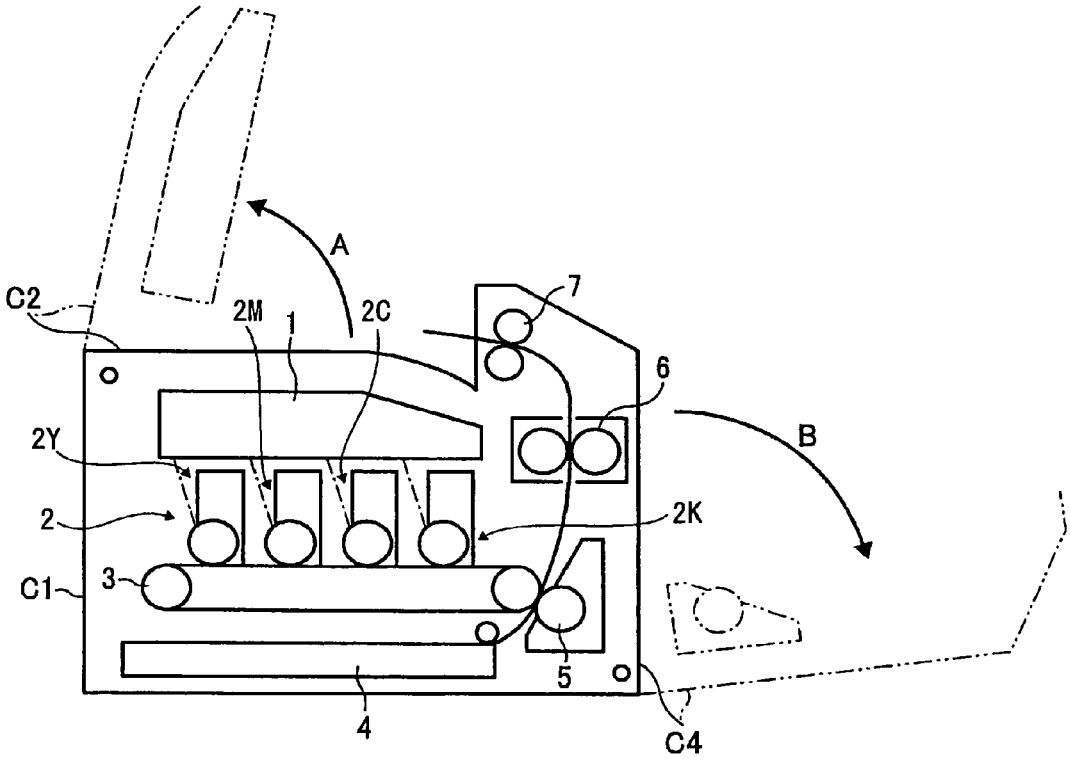
FIG. 1 is a schematic view schematically illustrating a printer having the housing of an embodiment of the present invention.

FIG. 1 is a schematic view schematically illustrating a printer as an image forming apparatus having the housing structure of an embodiment of the present invention. The main body functional part includes an image forming part 2 which has image forming stations 2Y, 2M, 2C, 2K of yellow (Y), magenta (M), cyan (C), and black (K), respectively, each having an image carrier such as a photoconductive drum and is configured to form an image on a sheet-like recording medium from the image carriers such as photoconductive drums of the image forming stations 2Y, 2M, 2C, 2K, an intermediate transfer belt 3, a paper feeding part 4, a secondary transfer part 5, a fixing part 6, a paper discharging part 7, and the like. The first structure includes a main body C1 and body frames 8. The separate body functional part includes an optical writing part 1 configured to perform an optical writing on each of the photoconductive drums of the image forming stations 2Y, 2M, 2C, 2K of the image forming part. The second structure includes the cover part C2 and the upper frames 9. By the above-mentioned configurations, a full-color image is formed in a commonly-used electrophotographic process. In this embodiment, a color printer in a tandem type of a so-called indirect transfer system is described.

As shown in FIG. 1, the optical writing part 1 is disposed so as to emit laser light beams for writing images of each color onto target positions of the image forming part 2 when the cover part C2 is closed. The optical writing part 1 is configured to be opened with a cover in a direction shown by an arrow A, and then the photoconductive drum units 2 are capable of being removed from the main body C1 through the upper opened part. The secondary transfer part 5 is configured to be opened with a cover C4 disposed at a side of the main body C1 in a direction shown by an arrow B and therefore paper jams can be easily fixed.

Figure 2:
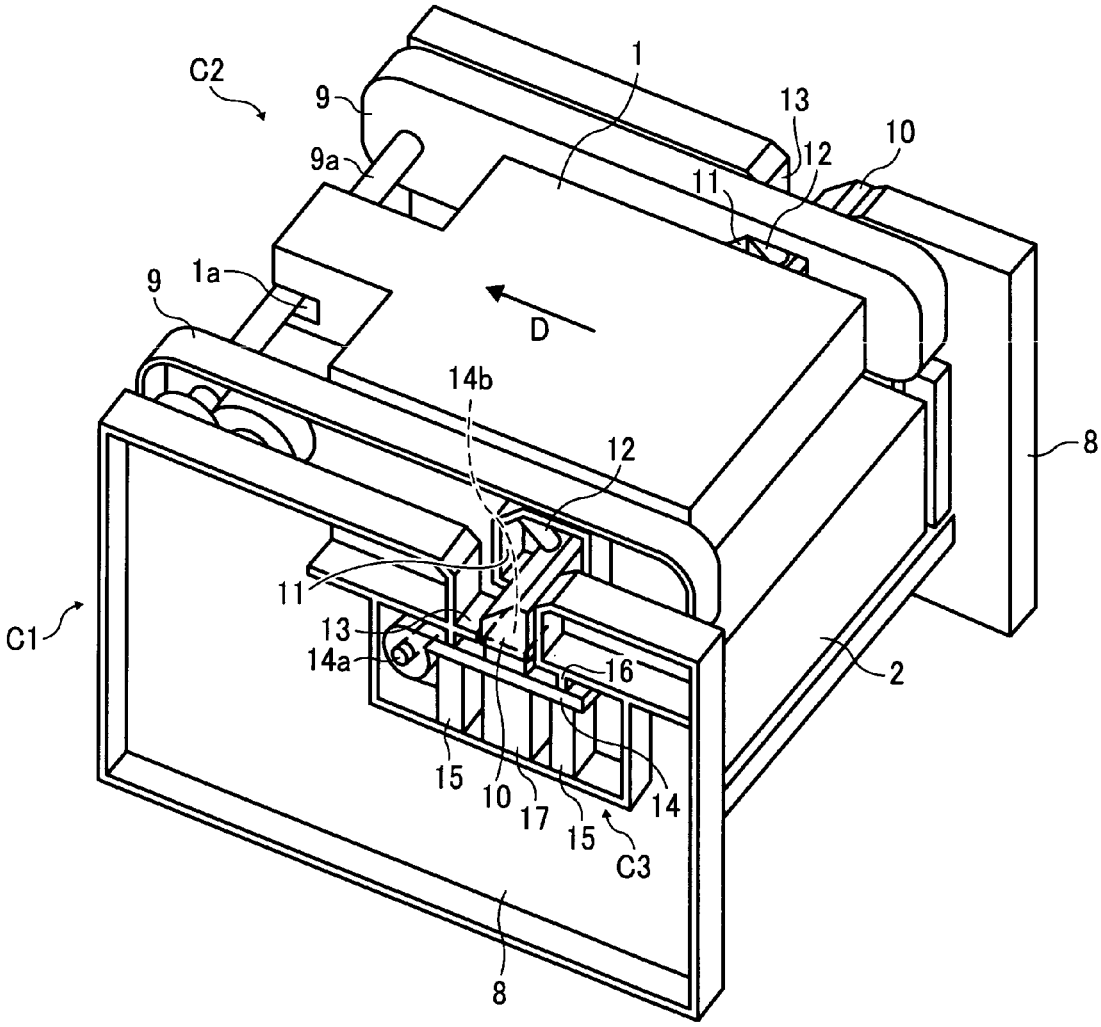
FIG. 2 is a view illustrating configurations of a main body and a cover part and showing an optical writing part, photoconductive drums, body frames and upper frames when printing is performed.

FIG. 2 is a view illustrating a configuration of the main body C1 and the cover part C2 and showing the optical writing part 1, the photoconductive drums 2, the body frames 8 and the upper frames 9 when printing is performed. The supporting member 10 of the optical writing part 1 passes through the upper frames 9 via retaining holes 11 and is elastically biased to be pressed against a retaining groove 13 as the first engagement portion of the body frame 8 by a second biasing member 12 as the second biasing device disposed between the upper frame 9 and the optical writing part 1 and therefore retained. The upper frame 9 is supported in an openable and closable state by the first shaft 9*a* at an end portion of one side of the body frame 8 (see the left side of FIG. 2).

FIG. 3 is a view illustrating a state where the optical writing part 1 is rotated in relation to the body frames 8. The first shaft 9*a* is supported at both ends of the first shaft 9*a* by the body frames, and the upper frames 9 are rotatably provided by the first shaft 9*a*. The supporting member 10 makes contact with the retaining hole 11 by a biasing force of the second biasing member 12 and is rotated with the upper frames 9.

As shown in FIGS. 2 and 3, an engagement groove 1*a* is provided on the optical writing part 1 and the first shaft 9*a* is engaged with the engagement groove 1*a* and supported. The optical writing part 1 is engaged movably in parallel along the first shaft 9*a* with the engagement groove 1*a*.

Next, a positioning structure in which the optical writing part 1 is positioned in relation to the body frames 8 will be explained in each embodiment.

First Embodiment 1

Figure 4:
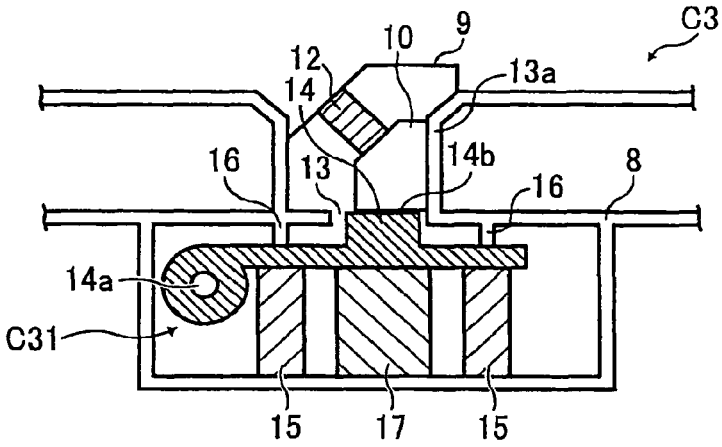
FIG. 4 is a view illustrating in detail a part where the optical writing part is positioned in relation to the body frames in a first embodiment.

FIG. 4 is a view illustrating in detail a part where the optical writing part 1 is positioned in relation to the body frames 8 in a first embodiment. The first biasing device is made of springs 15 as the first biasing member and an elastic member 17 as the damper.

The movable receiving member 14 is provided on the retaining groove 13 of the body frame 8 and the housing structure further includes a second shaft 14*a* as shown in FIG. 4. The body frame 8 is provided with positioning portions 16. The movable receiving member 14 is rotatably supported about the second shaft 14*a* on the body frame 8 and is held up by the springs 15 against the positioning portions 16 of the body frame 8. The elastic member 17 is inserted between the body frame 8 and the movable receiving member 14.

The supporting member 10 of the optical writing part 1 is elastically biased by the second biasing member 12 and makes contact with a front surface 13*a* of the retaining groove 13 of the body frame 8 as well as an upper surface (contact surface) 14*b* of the movable receiving member 14 to be positioned. The biasing force for biasing the movable receiving member 14 against the positioning portions 16 of the body frame 8 is set to be larger than a sum of the force which is given by the weight of the movable receiving member 14, the force which is given by the supporting member 10 of the optical writing part 1, and the biasing force of the second biasing member 12 to position the movable receiving member. The second biasing member 12 is, for example, a coil spring. The above-mentioned position is a predetermined position to be positioned.

In positioning of the optical writing part 1, when the supporting member 10 is elastically biased against the front surface 13*a* of the retaining groove 13, the optical writing part 1 is moved in a direction shown by an arrow D in FIG. 2 by the reaction. Accordingly, the optical writing part 1 is firmly positioned in relation to the image forming part 2 without the influence of a positioning accuracy of the upper frame 9.

In addition, the movable receiving member 14 is rotatably supported about the second shaft 14*a* to suppress a failure due to biting occurring when the movable receiving member 14 is horizontally moved. Accordingly, by rotatably supporting the movable receiving member 14, operation failure can be prevented from occurring. Thereby, it is possible to support abutting members by a simple supporting system and, in a case of rotatably supporting the movable receiving member 14, the movable receiving member can be more smoothly moved with a reduced biting than in a case of movably supporting in parallel.

The spring 15 may be a coil spring. By using the coil spring, a firm elastic force can be achieved with a simple structure and with a reduced change of the elastic force.

Figure 5:
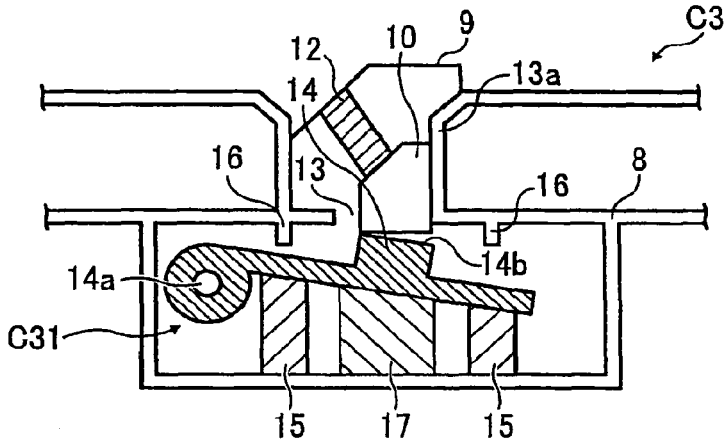
FIG. 5 is a view illustrating an operation when an impact is absorbed when the optical writing part is positioned.

FIG. 5 is a view illustrating an operation when an impact is absorbed when the optical writing part 1 is positioned. When the cover part C2 is closed, the supporting member 10 of the optical writing part 1 hits and makes contact with the movable receiving member 14. If the movable receiving member 14 is not provided on a positioning part as shown in a conventional housing structure, sufficient slowing-down distance cannot be obtained and therefore a speed of moving the optical writing part 1 is rapidly decreased. In addition, in a case of using high hardness resin or the like, a large impact is generated due to a generation of a repulsion force. The impact may cause damages of the apparatus. However, as in this embodiment, since the movable receiving member 14 is provided and the supporting member 10 is configured to make contact with the movable receiving member 14, the slowing-down distance by an over-stroke can be more reliably guaranteed than in the conventional positioning part. Accordingly, large impact can be prevented.

In this case, the elastic member 17 provided under the movable receiving member 14 is compressed and the repulsion force is decreased as the compression amount is increased so that a feed back force according to an amount of the over-stroke can be ensured. The movable receiving member 14 which is once moved with the over-stroke is returned at a predetermined position in relation to the main body by the spring 15 to position the optical writing part 14. At this time, although it is possible for an oscillation to be generated by the spring 15, the oscillation is dampened by the elastic member 17 and then immediately reduced.

Furthermore, due to the damping effect, oscillation unnecessary for the optical writing part 1 to be positioned is not given to the optical writing part 1 so that positioning accuracy can be maintained. Moreover, if the hardness and shape of the elastic member 17 are modified, the repulsive force can be arbitrarily adjusted. The elastic member 17 may be made of a resin material having elasticity, for example, a single foam sponge or a rubber. Thereby, a required buffer effect can be obtained with a simple member.

In addition, a large force is required when an amount of compression of the first biasing device is large. Then, it is advantageous to use the resin material such as the single foam sponge or the like, because the single foam or the like has a property such that a spring constant increases as the compressed amount of the single foam or the like increases, and therefore the above requirement can be satisfied.

Second Embodiment

Figure 6:
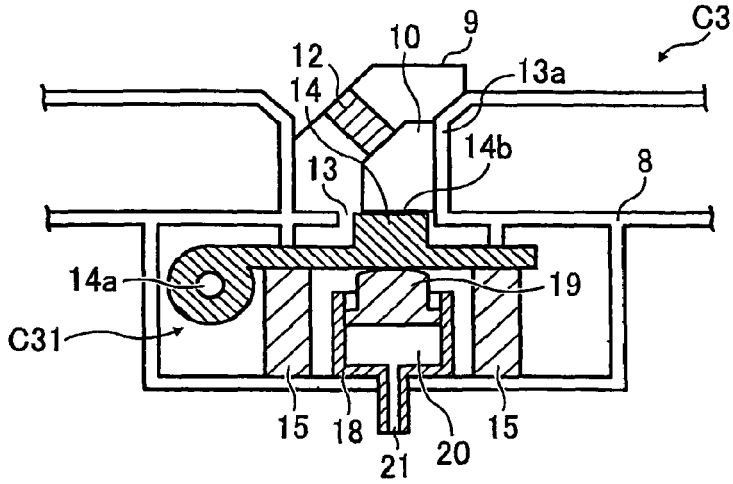
FIG. 6 is a view illustrating in detail a part where the optical writing part is positioned in relation to the body frames in a second embodiment.

FIG. 6 is a view illustrating in detail a part where the optical writing part 1 is positioned in relation to the body frames 8 in a second embodiment. In the second embodiment, a fluid damper by using a viscosity of the fluid is used as the elastic member 17 shown in FIG. 5.

The fluid damper includes an air cylinder 18, a piston 19, a compression chamber 20, and an orifice 21. A volume of the compression chamber 20 is decreased when the piston 19 is pressed. The compression chamber 20 communicates with an outside of the air cylinder 18 via the orifice 21 and air of the decreased volume of the compression chamber 20 is discharged to the outside of the air cylinder via the orifice 21. That is, when the supporting member 10 makes contact with the movable receiving member 14, the movable receiving member 14 is moved to press the piston 19 so that the air in the compression chamber 20 is discharged to the outside via the orifice 21. Since the air in the compression chamber 20 is pressed by the orifice 21, the compressed air has a drag or reaction, and then slowing down of the movable receiving member 14 and the damping operation are performed. The drag or reaction is adjustable by setting a diameter of the orifice 21.

As described above, the fluid damper is used so that the biasing force of the spring 15 can be adjusted according to speed in positioning. That is, when the speed in positioning is large, the biasing force for buffering is set to be large and when the speed in positioning is small, the biasing force for buffering is set to be small. The biasing force for buffering can be adjusted by a sectional area of the orifice so that the buffering force can be adjusted only by a simple structure.

In the above embodiment, the configurations which are not explained are almost the same as those in the first embodiment and operated similarly to those in the first embodiment.

Third Embodiment

Figure 7:
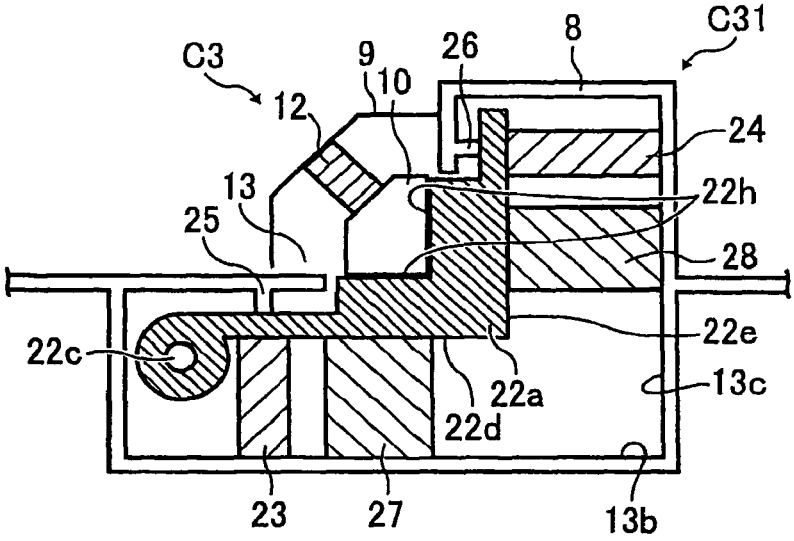
FIG. 7 is a view illustrating in detail a part where the optical writing part is positioned in relation to the body frames in a third embodiment.

FIG. 7 is a view illustrating in detail a part where the optical writing part 1 is positioned in relation to the body frames 8 in a third embodiment. In the third embodiment, an L-shaped movable receiving member 22*a* having two contact surfaces 22*h* at substantially right angles to each other is used. In the third embodiment, two side surfaces of the supporting member 10 of the optical writing part 1 are received by the two contact surfaces 22*h* of the movable receiving member 22*a*, respectively, to position the optical writing part 1, while, in the first and second embodiments, one surface of the supporting member 10 is received by the body frame 8 and another surface of the supporting member 10 is received by the movable receiving member 14 to position the optical writing part 1.

In FIG. 7, the movable receiving member 22*a* is rotatably supported about a second shaft 22*c* onto the body frame 8 in the retaining groove 13. The movable receiving member 22*a* is pressed against positioning portions 25, 26 of the body frame 8 by springs 23, 24. The positioning portions 25, 26 are disposed so as to extend in different directions from each other, for example, in directions perpendicular to each other. Elastic members 27, 28 are also provided between the body frame 8 and a receiving surface 13*b* or 13*c* of the retaining groove 13 so as to bias receiving surfaces 22*d*, 22*e* of the movable receiving member 22*a* in directions parallel to extending directions of the positioning portions 25, 26. Accordingly, the operation shown in FIG. 5 can be achieved in two directions.

In the above embodiment, the configurations which are not explained are almost the same as those in the first and second embodiments and operated similarly to those in the first and second embodiments.

Fourth Embodiment

Figure 8:
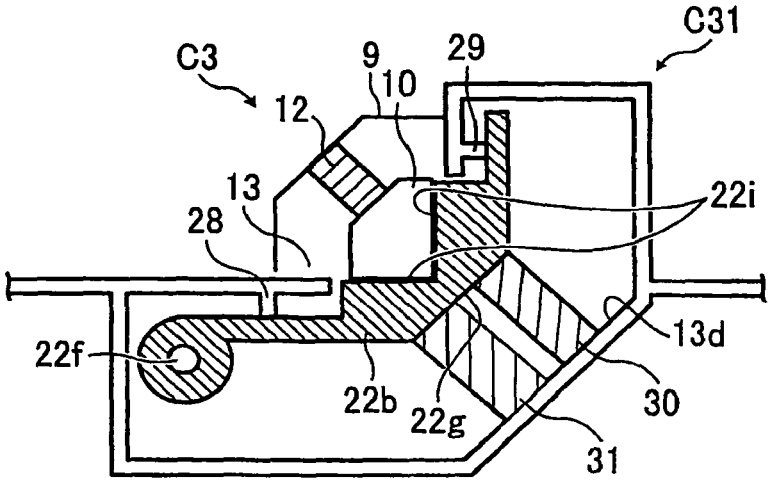
FIG. 8 is a view illustrating in detail a part where the optical writing part is positioned in relation to the body frames in a fourth embodiment.

FIG. 8 is a view illustrating in detail a part where the optical writing part 1 is positioned in relation to the body frames 8 in a fourth embodiment. In the fourth embodiment, the movable receiving member is biased in a direction of total force at 45 degrees, while the movable receiving member is biased in the two directions in the third embodiment. That is, in the third embodiment, when the supporting member 10 makes contact with two contact surfaces 22*i* perpendicular to each other of the movable receiving member 22*b*, damping of contacting force of the supporting member 10 is performed separately in two directions. On the other hand, in the fourth embodiment, the movable receiving member 22*b* is biased by a spring 30 and an elastic member 31 in one direction of the total force, that is, in a middle direction of the two directions perpendicular to each other. A receiving surface 13*d* which is inclined at about 45 degrees from the receiving surfaces 13*b*, 13*c* is provided in the retaining groove 13 and the movable receiving member 22*b* includes a receiving surface 22*g* which is inclined at about 45 degrees in relation to the receiving surfaces 22*d*, 22*e* of the movable receiving member 22*a*. The spring 30 and the elastic member 31 are disposed between the receiving surface 13*d* and the receiving surface 22*g*. The movable receiving member 22*b* is rotatably supported about the second shaft 22*f*.

According to the above-mentioned configurations, only one set of the spring and the elastic member are required while two sets of the spring and the elastic member are required in the third embodiment.

In the above embodiment, the configurations which are not explained are almost the same as those in the first to third embodiments and operated similarly to those in the first to third embodiments.

According to an embodiment of the present invention, when a cover part as a second structure is closed onto a main body as a first structure, an impact occurring when the cover part makes contact with the main body is buffered or relaxed by a force of difference between biasing forces of a first biasing device and a second biasing device. A supporting member is positioned by the second biasing device and a movable receiving member at a predetermined position of the first structure so that high accuracy can be achieved in relatively positioning a separate body functional part provided in the cover part and a main body functional part provided in the main body, and also buffering the impact affecting equipment provided in the cover part in the closing operation can be achieved.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A housing structure, comprising a first structure configured to house a main body functional part, the first structure having body frames disposed at opposite sides of the first structure and a first shaft supported by the body frames;

a second structure configured to house a separate body functional part and to be movably supported between an opened position and a closed position by the first shaft of the first structure; and a positioning device configured to position the separate body functional part in relation to the main body functional part in the closed position, the positioning device including:

a first engagement portion provided on the first structure;

a second engagement portion provided on the second structure, the second engagement portion being engaged with the first engagement portion in the closed position;

a first biasing device configured to bias the second engagement portion toward the second structure; and a second biasing device configured to bias the second engagement portion toward the first structure, wherein the positioning device is configured to position the separate body functional part in relation to the main body functional part by biasing forces of the first biasing device and the second biasing device, wherein the positioning device includes a movable receiving member configured to make contact with the second engagement portion and to be pressed by the first biasing device to position the second structure in relation to the first structure in the closed position, and wherein the first biasing device includes a second shaft, and the movable receiving member is supported rotatably about the second shaft at a side in relation to the first structure.

2. The housing structure according to claim 1, further including positioning members are provided on the body frame of the first structure, wherein the movable receiving member is positioned at a predetermined position of the first structure by the positioning members in a state where the movable receiving member is pressed by the first biasing device.

3. The housing structure according to claim 1, wherein the second engagement portion is configured to make contact with the movable receiving member in a state where the second engagement portion is biased by the second biasing device toward the first structure.

4. The housing structure according to claim 1, wherein a biasing force of the first biasing device is set to be larger than a biasing force of the second biasing device.

5. The housing structure according to claim 1, wherein the separate body functional part has an end where an engagement groove is formed, and wherein the separate body functional part is engaged movably in parallel along the first shaft with the engagement groove.

6. The housing structure according to claim 1, wherein the first biasing device has a spring.

7. The housing structure according to claim 1, wherein the first biasing device has a spring and a damper.

8. The housing structure according to claim 7, wherein the damper is an elastic body made of a resin material.

9. The housing structure according to claim 7, wherein the damper is either a single foam sponge or a rubber.

10. The housing structure according to claim 7, wherein the damper is a fluid damper by using a viscosity of the fluid.

11. The housing structure according to claim 10, wherein the fluid damper includes an air cylinder, a piston, a compression chamber, and an orifice, wherein a volume of the compression chamber is decreased when the piston is pressed and the compression chamber communicates with an outside of the air cylinder via the orifice.

12. An image forming apparatus comprising the housing structure according to claim 1, wherein the main body functional part of the first structure has an image forming part which has an image carrier and is configured to form an image on a sheet-like recording medium from the image carrier; and wherein the separate body functional part of the second structure has an optical writing part configured to perform an optical writing on the image carrier of the image forming part.

13. A housing structure, comprising a first structure for housing a main body functional part, the first structure having body frames disposed at opposite sides of the first structure and a first shaft supported by the body frames;

a second structure for housing a separate body functional part and to be movably supported between an opened position and a closed position by the first shaft of the first structure; and a positioning means for positioning the separate body functional part in relation to the main body functional part in the closed position, the positioning means including:

a first engagement portion provided on the first structure;

a second engagement portion provided on the second structure, the second engagement portion being engaged with the first engagement portion in the closed position;

a first biasing means for biasing the second engagement portion toward the second structure; and a second biasing means for biasing the second engagement portion toward the first structure, wherein the positioning means is configured to position the separate body functional part in relation to the main body functional part by biasing forces of the first biasing means and the second biasing means, wherein the positioning device includes a movable receiving member configured to make contact with the second engagement portion and to be pressed by the first biasing device to position the second structure in relation to the first structure in the closed position, and wherein the first biasing device includes a second shaft, and the movable receiving member is supported rotatably about the second shaft at a side in relation to the first structure.

* * * * *